US010247390B1

(12) United States Patent
Kopitzke, IV

(10) Patent No.: US 10,247,390 B1
(45) Date of Patent: Apr. 2, 2019

(54) COMPACT TILTABLE AND ROTATABLE RECESSED LIGHTING FIXTURE

(71) Applicant: DMF Inc., Carson, CA (US)

(72) Inventor: Frederick Kopitzke, IV, Long Beach, CA (US)

(73) Assignee: DMF INC., Carson, CA (US)

( * ) Notice: Subject to any disclaimer, the term of this patent is extended or adjusted under 35 U.S.C. 154(b) by 0 days.

(21) Appl. No.: 15/637,742

(22) Filed: Jun. 29, 2017

(51) Int. Cl.

| | |
|---|---|
| ***F21V 17/02*** | (2006.01) |
| ***F21V 29/77*** | (2015.01) |
| ***F21V 23/00*** | (2015.01) |
| ***F21S 8/02*** | (2006.01) |
| ***F21V 3/02*** | (2006.01) |
| ***F21V 14/02*** | (2006.01) |
| ***F21V 17/12*** | (2006.01) |
| ***F21V 23/06*** | (2006.01) |

(52) U.S. Cl.
CPC ..... *F21V 17/02* (2013.01); *F21S 8/026* (2013.01); *F21V 3/02* (2013.01); *F21V 14/02* (2013.01); *F21V 17/12* (2013.01); *F21V 23/001* (2013.01); *F21V 23/06* (2013.01); *F21V 29/77* (2015.01)

(58) Field of Classification Search
CPC ..... G02F 1/133788; G02F 1/1368; G02F 1/133345; G02F 1/133514; G02F 1/133528; G02F 2201/124; G02F 2201/121; G02F 2201/123; G02F 2001/133738; G02F 2202/023
See application file for complete search history.

(56) References Cited

U.S. PATENT DOCUMENTS

| | | | | |
|---|---|---|---|---|
| 8,092,035 | B2 * | 1/2012 | Mandy | B66B 11/0233 362/147 |
| 9,347,655 | B2 | 5/2016 | Boomgaarden et al. | |
| 9,581,302 | B2 | 2/2017 | Danesh | |
| 2013/0322062 | A1 | 12/2013 | Danesh | |
| 2014/0254177 | A1 | 9/2014 | Danesh | |
| 2014/0268823 | A1 * | 9/2014 | Mandy | F21V 19/0015 362/364 |
| 2014/0369053 | A1 * | 12/2014 | Ting | F21K 9/20 362/373 |
| 2015/0276185 | A1 | 10/2015 | Bailey et al. | |
| 2016/0312987 | A1 | 10/2016 | Danesh | |
| 2016/0348860 | A1 | 12/2016 | Bailey | |
| 2016/0348861 | A1 | 12/2016 | Bailey et al. | |
| 2017/0045213 | A1 | 2/2017 | Williams et al. | |
| 2017/0138576 | A1 | 5/2017 | Peng et al. | |

* cited by examiner

*Primary Examiner* — Joseph L Williams
*Assistant Examiner* — Jose M Diaz
(74) *Attorney, Agent, or Firm* — Foley & Lardner LLP

(57) ABSTRACT

Embodiments relate generally to a compact and adjustable luminaire. In embodiments, the luminaire can be completely rotated a full 360 degrees and also can be tilted through a range of 45 degrees from directly downward. According to certain aspects, luminaire can be easily installed from below the ceiling line in a fire rated junction box. According to certain additional aspects, the luminaire can further be easily adjusted after installation to any desired tilt angle and/or any desired rotation. In embodiments, the luminaire can incorporate different lenses with narrow to moderate beam spreads from 10 degrees to 40 degrees.

23 Claims, 7 Drawing Sheets

COMPACT TILTABLE AND ROTATABLE RECESSED LIGHTING FIXTURE

TECHNICAL FIELD

The present embodiments relate generally to lighting, and more particularly to a recessed lighting fixture that is tiltable and rotatable and yet is also compact.

BACKGROUND

The inventions of the present applicant such as those described in U.S. Pat. No. 9,581,302 and U.S. Patent Publ. Nos. 2017/0045213, 2016/0348861, 2016/0348860 and 2015/0276185, the contents of which are incorporated herein by reference in their entirety, have dramatically advanced the state of the art of lighting technology. However, opportunities for further improvements remain. For example, in certain residential lighting applications it is desirable to be able to adjust the beam from a light source so as to highlight a different area of a room or to provide a desired wall wash effect, for example. To achieve this goal in a recessed lighting fixture is very challenging. Past attempts at adjustable recessed lighting fixtures are bulky and difficult to install in environments such as residential ceilings.

SUMMARY

Embodiments relate generally to a compact and adjustable luminaire. In embodiments, the luminaire can be completely rotated a full 360 degrees and also can be tilted through a range of 45 degrees from directly downward. According to certain aspects, luminaire can be easily installed from below the ceiling line in a fire rated junction box. According to certain additional aspects, the luminaire can further be easily adjusted after installation to any desired tilt angle and/or any desired rotation. In embodiments, the luminaire can incorporate different lenses with narrow to moderate beam spreads from 10 degrees to 40 degrees.

BRIEF DESCRIPTION OF THE DRAWINGS

These and other aspects and features of the present embodiments will become apparent to those ordinarily skilled in the art upon review of the following description of specific embodiments in conjunction with the accompanying figures, wherein.

DETAILED DESCRIPTION

The present embodiments will now be described in detail with reference to the drawings, which are provided as illustrative examples of the embodiments so as to enable those skilled in the art to practice the embodiments and alternatives apparent to those skilled in the art. Notably, the figures and examples below are not meant to limit the scope of the present embodiments to a single embodiment, but other embodiments are possible by way of interchange of some or all of the described or illustrated elements. Moreover, where certain elements of the present embodiments can be partially or fully implemented using known components, only those portions of such known components that are necessary for an understanding of the present embodiments will be described, and detailed descriptions of other portions of such known components will be omitted so as not to obscure the present embodiments. In the present specification, an embodiment showing a singular component should not be considered limiting; rather, the present disclosure is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present embodiments encompass present and future known equivalents to the known components referred to herein by way of illustration.

The present embodiments relate generally to an adjustable recessed lighting fixture that is rotatable and tiltable and can be configured with narrow to moderate beams spreads designed for residential applications. In embodiments, the driver is internal to the luminaire and can accept lenses having different beam spreads using a screw on lens cap. It can be used as a replacement for or interchange at any time any other module using the same type of receptacle such as a junction box. The junction box is thus installed anywhere above the ceiling line and can be populated by any desired module, including the adjustable luminaire according to embodiments. The junction box is preferably fire rated, making it unnecessary to obtain a fire rating for the luminaire.

Figure 1:
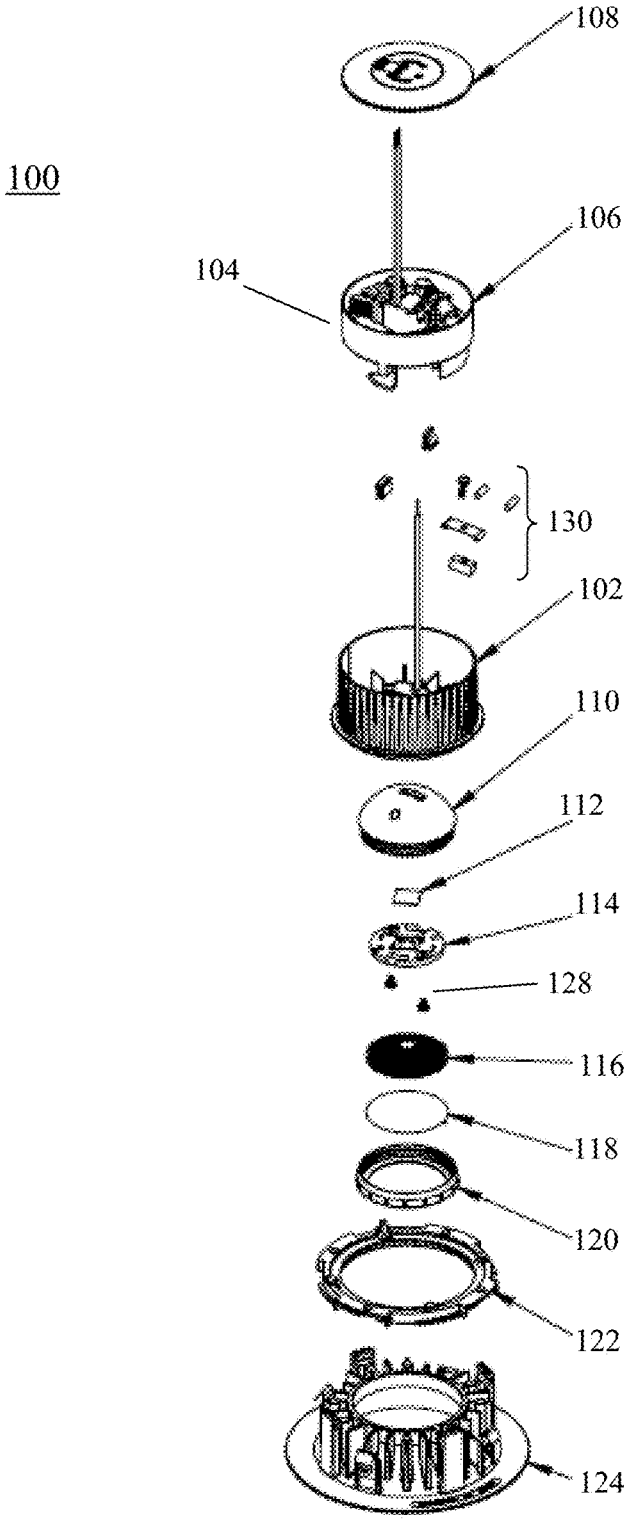
FIG. 1 illustrates components of an example luminaire that may be installed within a wall or a ceiling according to the present embodiments.

FIG. 1 illustrates components of an example luminaire that may be installed within a wall or a ceiling according to the present embodiments. As shown, an example of luminaire 100 according to the present embodiments is comprised of a housing 102, light source module 104, tiltable heat sink 110, light source 112, light source holder 114, optical element or lens 116, diffusion film 118, screw cap 120, mounting ring 122 and optional trim 124.

According to certain general aspects, and as will be explained in more detail below, heat sink 110 is attached to housing 102 via fasteners 130, which allow the heat sink 110 to tilt up to 45 degrees with respect to a straight downward orientation from housing 102, but without requiring oversized mechanisms and while remaining completely within housing 102 so that the overall luminaire remains compact in size. Light source 112 is mounted on holder 114 and holder 114 is attached to heat sink 110 via screws 128, and as such, light source 112 tilts along with heat sink 110, thereby directing light from light source according to any desired angle in the tiltable range. Mounting ring 122 is attached to housing 102, and can rotatably engage with trim 124, which can thereby further provide additional desired lighting effects.

Light source module 104 is mounted within light source insulator 106 having a cap 108 and contained inside the housing 102. Light source module 104 is an electronic circuit or device that supplies and/or regulates electrical energy to the light source 112 via wires (not shown) and thus powers the light source 112 to emit light. The light source module 104 may include any type of power supply circuit, including one that includes power converters, rectifiers, power transistors and the like for delivering an appropriate alternating current (AC) or a direct current (DC) voltage to the light source 112. Upon receiving electricity, the light source module 104 may regulate current or voltage to supply a stable voltage or current within the operating parameters of the light source 112. In embodiments, the light source module 104 receives an input current from an electrical power wiring network of the building or structure in which the luminaire 100 is installed, and may drop the voltage of the input current to an acceptable level for the light source 112 (e.g., from 120V-277V to 36V-48V).

Light source insulator 106 in embodiments may be made of heat resistant or insulating plastic, for example plastic and composites comprising materials selected from a group consisting of semi-crystalline polyamides, polyamide alloys, polymers, minerals, glass, carbon, steel fibers, etc. In these and other embodiments, insulator 106 may be formed by injection molding, extrusion, and similar fabrication techniques and dimensioned in accordance with light source module 104, which is held into place inside insulator 106 via clips 126.

Light source 112 may be any electro-optical device or combination of devices for emitting light. For example, the light source 112 may have one or more light emitting diodes (LEDs, such as an XLamp LED from Cree), organic light-emitting diode (OLEDs), or polymer light-emitting diode (PLEDs). The light source 112 receives electricity from the light source module 104, as described above, such that the light source 112 can emit a controlled beam of light toward lens 116, and thus into a room or surrounding area of the luminaire 100 (when installed behind a ceiling or wall). Lens 116 is secured into place by screw-on lens cap 118, which then fixedly positions light source 112 to appropriately emit light into lens 116 and outward from luminaire 100. This allows for easy installation and for accommodating lenses having different beam spreads.

Light source holder 114 provides a rigid structure for mounting light source 112 in heat sink 110 and also provides poke-in wire connectors for allowing power to be electrically connected to light source 112 from light source module 104.

Figure 2A:
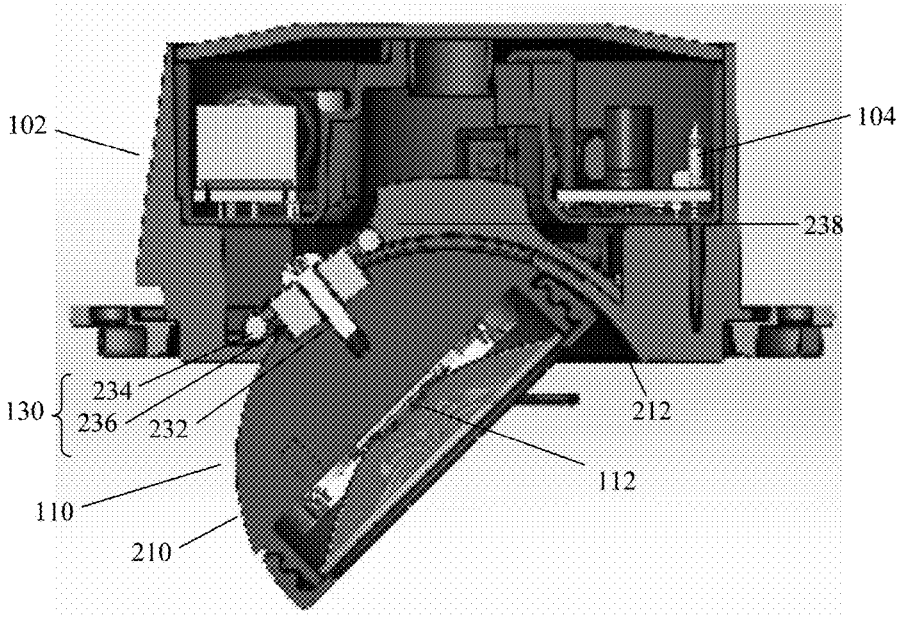
FIGS. 2A and 2B illustrate aspects mentioned above regarding how a heat sink is allowed to adjustably tilt with respect to a housing in example embodiments of a luminaire such as that illustrated in FIG. 1.
Figure 2B:
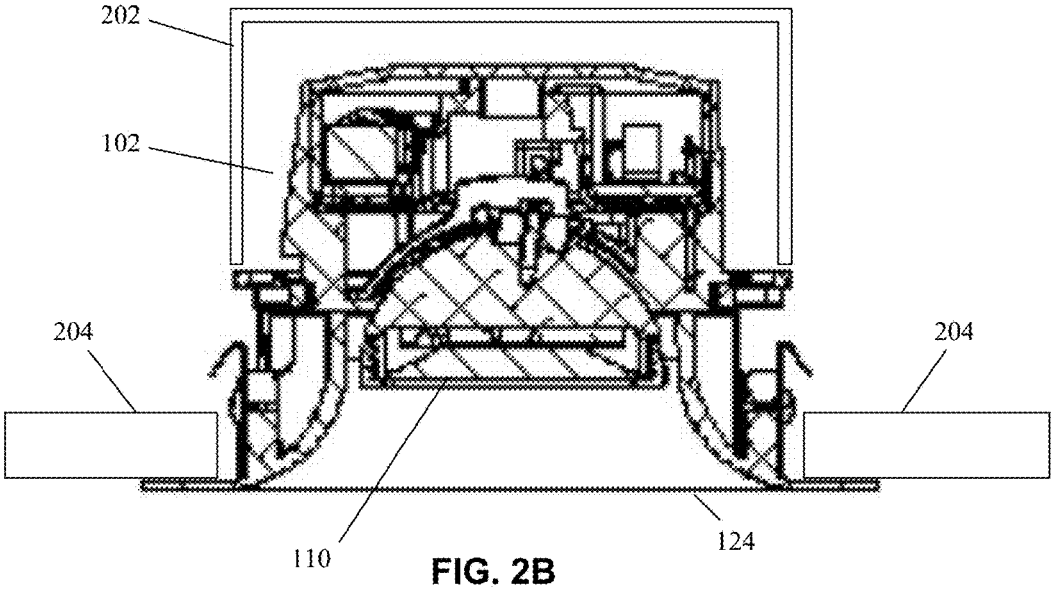

FIGS. 2A and 2B illustrate aspects mentioned above regarding how heat sink 110 is allowed to adjustably tilt with respect to housing 102 in a compact manner according to example embodiments of luminaire 100.

More particularly, FIG. 2A is a cross-sectional view showing an assembly of housing 102 and tiltable heat sink 110. As set forth above, when heat sink 110 is attached to housing 102 via fasteners 130, heat sink 110 can be adjustably tilted to any desired angle up to, in embodiments 45 degrees with respect to a straight downward orientation.

As shown in more detail in FIG. 2A, in example embodiments, fasteners 130 include a screw 232 that is screwed into heat sink 110 and which thereby secures bushing 234 (e.g., comprised of plastic) in track 238 of housing 102. Screw 232 further secures standoff 236 in a depression of heat sink 110. When screw 232 and standoff 236 are thus secured in heat sink 110, this allows the bushing 234 to travel in track 238 while keeping the heat sink 110 attached to housing 102, and thus allowing heat sink 110 to be tilted in any desired angle. This therefore allows a beam from light source 112 to be adjustably directed in any corresponding desired direction.

As can be seen in FIG. 2A, and as will become even more apparent from further descriptions below, an outer top surface 210 of heat sink 110 and an inner surface 212 of housing 102 have matching hemispherical shapes to permit free tilting movement by heat sink 110 with respect to housing 102. This further allows for an overall compact design. As described in more detail below, wires from light source module 104 are connected to light source 112 to deliver power through holes in outer top surface 210 of heat sink 110 and inner surface 212 of housing 102 that are mutually arranged to allow the wires to remain connected throughout the range of tilting movement between heat sink 110 and housing 102.

FIG. 2B illustrates aspects of the tilting features of luminaire 100 in an example where luminaire 100 is used as a downlight in a ceiling. It should be apparent that this is a simplified drawing for illustrating aspects of embodiments.

As shown in FIG. 2B, housing 102 is mounted within junction box 202 behind a hole in ceiling 204. Junction box 202 can be attached to ceiling structures using mechanisms such as hanger bars (not shown). As shown in the example of FIG. 2B, trim 124 is attached to housing 102 and is flush with downward facing surface of ceiling 204. This allows for tiltable heat sink 110 to be accessed from below ceiling 204 and its tilt adjusted to any desired angle while housing 102 remains installed behind the ceiling 204 in junction box 202.

Junction box 202 is thus installed anywhere above the ceiling 204. Junction box 202 is preferably fire rated so that it is unnecessary to obtain a fire rating for the luminaire 100, which is a distinct advantage because obtaining a fire rating for luminaire 100 would otherwise require expensive design and testing. Junction box 202 of the present embodiments is also rather compact and saves valuable space above the ceiling line. Examples of junction box 202 that can be used in the present embodiments are described in commonly-owned U.S. patent application Ser. Nos. 14/942,937 and 15/132,875, the contents of which are incorporated by reference herein in their entirety.

According to certain additional aspects, luminaire 100 according to embodiments can be attached to junction box 202 using a universal adapter (not shown) such as that described in commonly-owned U.S. patent application Ser. No. 14/726,064, the contents of which are incorporated by reference herein in their entirety. This allows for luminaire 100 to be easily installed into junction box 202 from below the ceiling any time after junction box 202 has been installed behind the ceiling. This further allows for luminaire 100 to be interchanged with, or replace, other luminaires that are sized and configured to use the universal adapter for engaging with junction box 202.

In embodiments shown in FIG. 2B, trim 124, when attached to housing 102, is preferably flush with ceiling 204. Moreover, as will be described in more detail below, corresponding structures in trim 124 and housing 102 allow the trim 124 to freely rotate, thereby providing desired lighting effects for luminaire 100. Examples of trim 124 are described in commonly-owned U.S. Patent Publication No. 2013/0322062, the contents of which are incorporated by reference herein in their entirety.

Figure 3A:
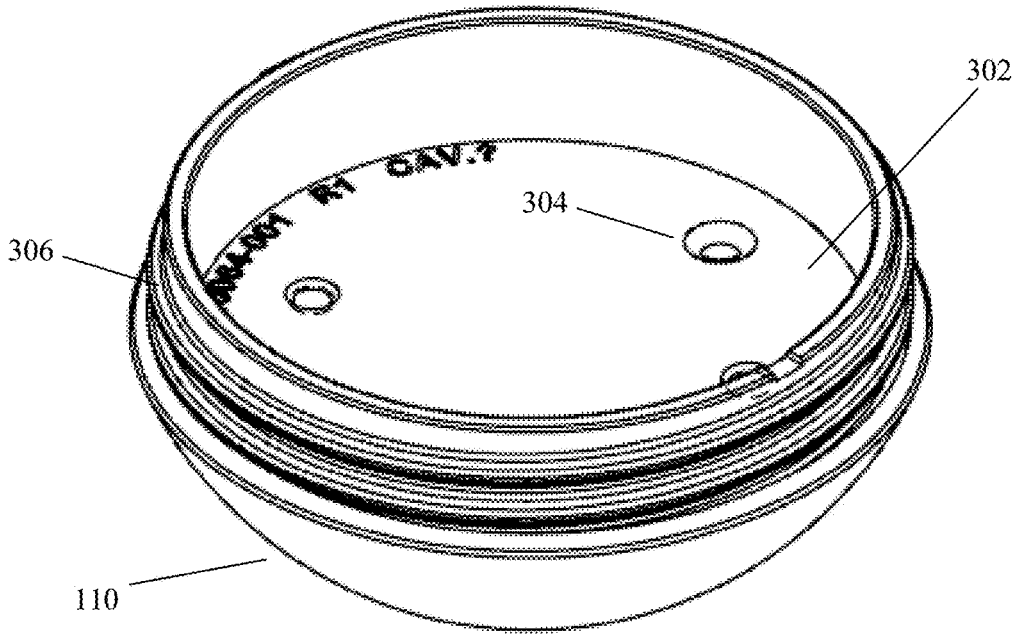
FIGS. 3A and 3B are bottom and top perspective drawings, respectively, of an example of tiltable heat sink according to embodiments such as that shown in FIG. 1.
Figure 3B:
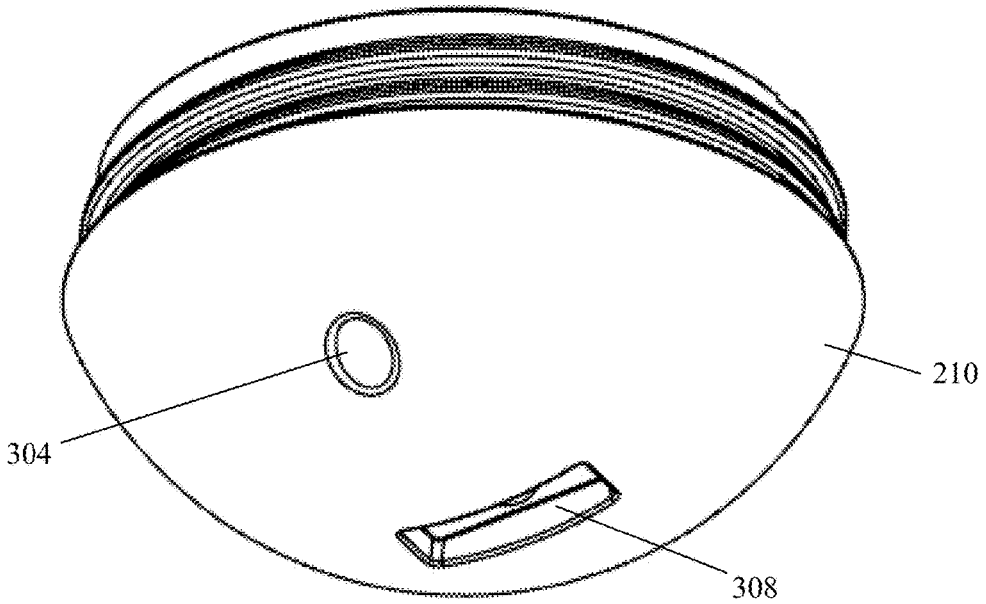

FIGS. 3A and 3B are bottom and top perspective drawings, respectively, of an example of tiltable heat sink 110 according to embodiments such as that shown in FIG. 1.

Heat sink 110 in embodiments includes cavity 302 for receiving light source 112, light source holder 114, lens 116 and film 118. In embodiments such as that shown in FIG. 3A, light source holder 114 is secured in cavity 302 via screws (not shown) that screw into screw holes 320. Cavity 302 of heat sink 110 further includes one or more holes 304 for allowing wires connecting power from light source module 104 in housing 102 to light source 112 to attach to light source holder 114 in cavity 302. Heat sink 110 includes threads 306 at its outer bottom periphery for engaging with a lens cap 120 to thereby cause lens 116 and film 118 to be secured into place in cavity 302.

As shown in FIG. 3B, on hemispherically shaped top surface 210, heat sink 110 also includes depression 308 for receiving standoff 326 of fasteners 130. As further shown, top surface 210 also includes holes 310 for allowing wires connecting power from light source module 104 in housing 102 to light source 112 to pass to holes 304 in cavity 302.

In embodiments, heat sink 110 is comprised of die cast aluminum or aluminum alloy. In other possible embodiments, heat sink 110 is comprised of copper, copper-tungsten pseudoalloy, AlSiC (silicon carbide in aluminum matrix), Dymalloy (diamond in copper-silver alloy matrix), E-Material (beryllium oxide in beryllium matrix), aluminum alloys such as 2024, 6061, etc., steel and/or other thermally conductive plastics or ceramics.

Figure 4A:
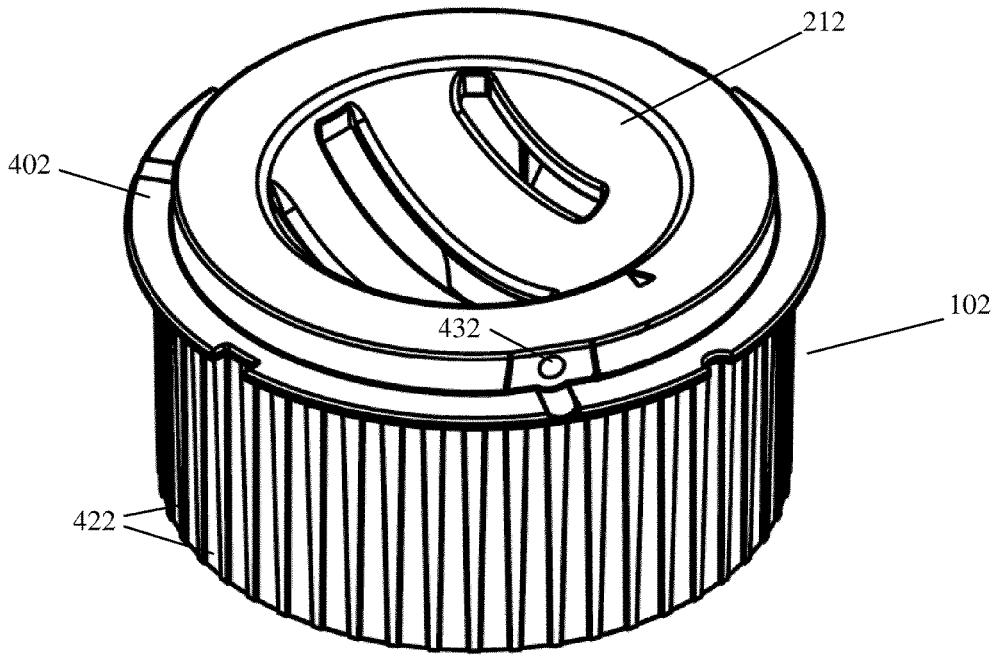
FIGS. 4A, 4B and 4C are perspective, bottom and cutaway drawings, respectively, of an example housing such as that shown in FIG. 1 according to embodiments.
Figure 4B:
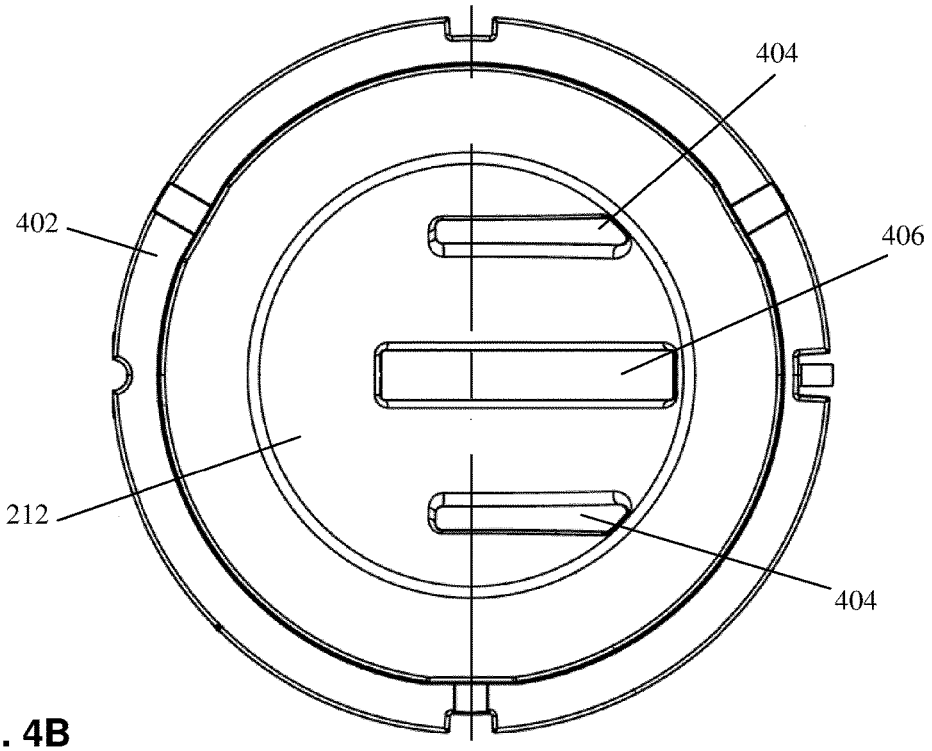
Figure 4C:
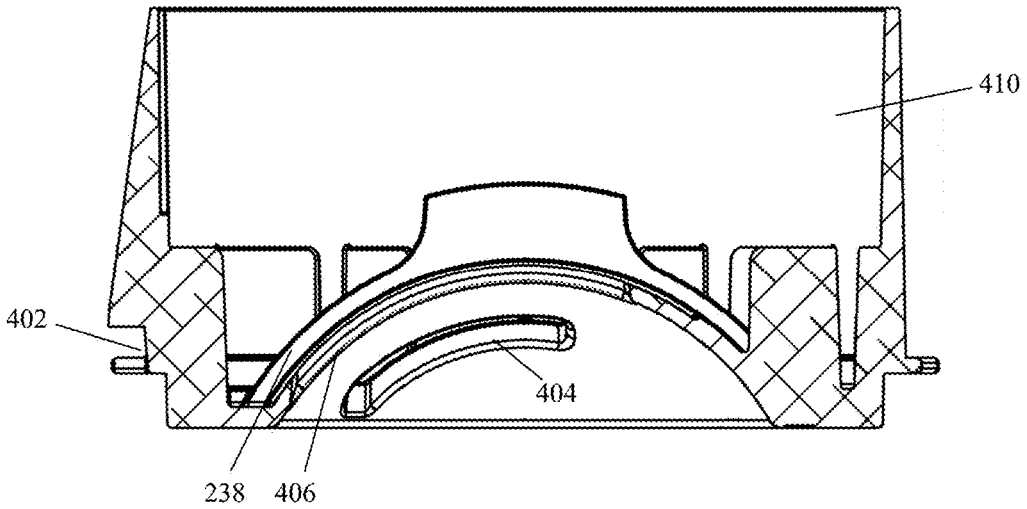

FIGS. 4A, 4B and 4C are perspective, bottom and cutaway drawings, respectively, of an example housing 102 such as that shown in FIG. 1 according to embodiments.

As shown in FIG. 4A, housing 102 includes bottom hemispherically shaped inner surface 212 for matching with similarly shaped outer surface 210 of heat sink 110. Housing 102 further includes a mounting ring receptacle 402 for engaging with mounting ring 122 as will be described in more detail below. As shown in the example of FIG. 4A, housing 102 includes integrally formed fins 422 for assisting in cooling of light source module 104.

As shown in FIG. 4B, an inner surface 212 of housing 102 includes elongated wire holes 404 for allowing wires to pass from light source module 104 to light source 112, for example via corresponding holes 304 in top surface 210 of tiltable heat sink 110. The design of holes 404 shown in this example thus allows the wires to travel along with heat sink 110 through the full range of tilt movement between heat sink 110 and housing 102 when heat sink 110 is attached to housing 102 via fasteners 130. Inner surface 212 of housing 102 further includes elongated standoff hole 406 for likewise accommodating standoff 236 through the full range of tilt movement between heat sink 110 and housing 102 when heat sink 110 is attached to housing 102 via fasteners 130.

As shown in FIG. 4C, housing 102 in this example embodiment includes track 238 for allowing bushing 234 of tiltable heat sink 110 to travel therein through the full range of tilt movement between heat sink 110 and housing 102 when heat sink 110 is attached to housing 102 via fasteners 130. Housing 102 in this example further includes cavity 410 for accommodating light source module 104.

Housing 102, including integrally formed fins 422, may be composed of any thermally conductive material so as to help cool the luminaire during operation of light source 112. For example, housing 102 including integrally formed fins 422 may be comprised of injection molded thermally conductive plastic. In other embodiments, housing 102 and/or fins 422 may be made of aluminum alloys, copper, copper-tungsten pseudoalloy, AlSiC (silicon carbide in aluminum matrix), Dymalloy (diamond in copper-silver alloy matrix), E-Material (beryllium oxide in beryllium matrix), and/or other thermally conductive plastics or ceramics.

Figure 5A:
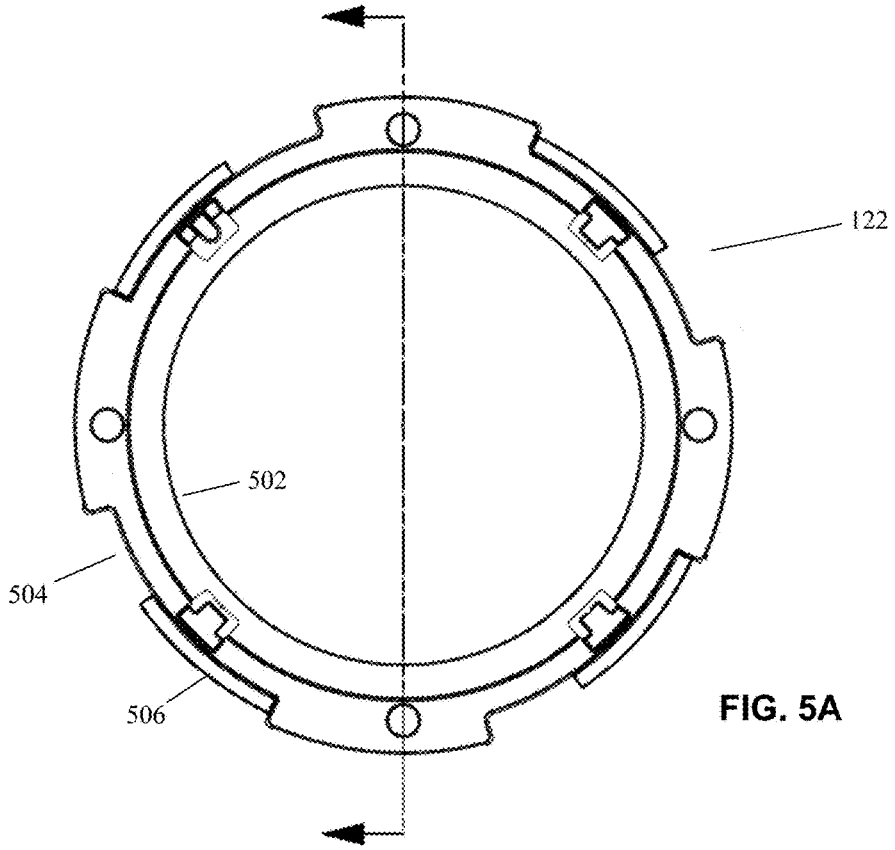
FIGS. 5A and 5B are bottom and cross-sectional views, respectively, of an example mounting ring according to embodiments such as that shown in FIG. 1.
Figure 5B:
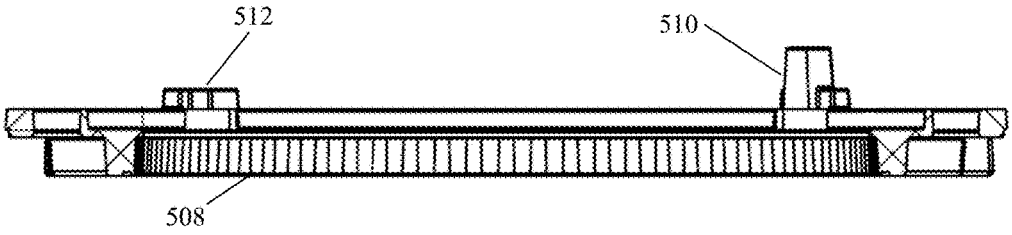

FIGS. 5A and 5B are bottom and cross-sectional views, respectively, of an example mounting ring 122 according to embodiments.

According to certain aspects mentioned above, mounting ring 122 in these embodiments allows trim 124 to be rotatably attached to housing 102. In accordance with these and other aspects, as shown in FIG. 5A, this example embodiment of mounting ring 122 includes an interior periphery 502 and an outer periphery 504. As can be further seen in FIG. 5A, outer periphery 504 includes twist and lock structures 506 for mating with corresponding structures in a trim 124.

Meanwhile, as can be seen in FIG. 5B, inner periphery 502 of mounting ring 122 includes detents 508. When the inner periphery 502 is engaged with receptacle 402 of housing 102 (e.g. by a snap fit), mounting ring 122 is thus allowed to rotate with respect to housing 102, thereby providing corresponding desired lighting effects. Detents 508 provide a "clicking" sensation or sound during such rotation, which is helpful feedback for persons who are adjusting the rotation. For example, when inner periphery 502 is engaged with receptacle 402, such "clicking" can be caused when detents 508 cause ball plunger mechanism 432 to depress and release as the mounting ring 122 is rotated.

As further shown in FIG. 5B, mounting ring 122 includes structures 510 and 512. These structures can provide limits on rotation and to hold the outer ring to the heat sink, for example. In embodiments, mounting ring 122 is fabricated (e.g. injection molded) using materials such as long-fiber or short-fiber reinforced polyamides. The reinforcing fibers can be glass or carbon or hybrid fibers. The polyamide material can be semi-crystalline.

Figure 6A:
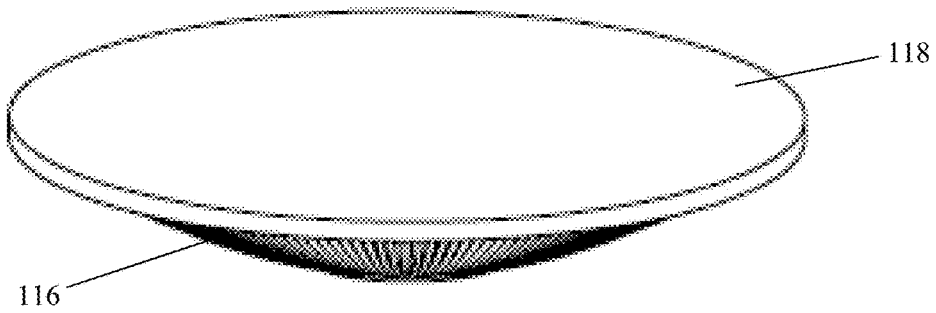
FIGS. 6A and 6B are bottom perspective and side views of an example lens according to embodiments such as that shown in FIG. 1.
Figure 6B:
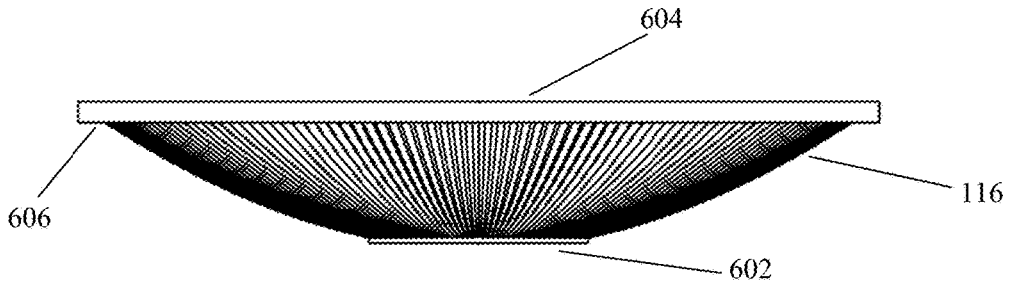

FIGS. 6A and 6B are bottom perspective and side views of an example lens 116 according to embodiments.

As shown, lens 116 includes a beam ingress surface 602 that receives light from light source 112 when assembled in heat sink 110 together with light source 112, and beam egress surface 604. Lens 116 further includes flange portion 606 on an outer periphery thereof, and which engages with a corresponding flange portion of lens cap 120 as will be described in more detail below.

In embodiments, lens 116 is comprised of any at least partially transparent material, including glass and hard plastics. For example, lens 116 may be comprised of polycarbonite material. In one embodiment, when locked into place via lens cap 120, the lens 116 also provides a protective barrier for the light source 112 and shields the light source 112 from moisture or inclement weather.

In these and other embodiments, lens 116 is a total internally reflective lens and has a designed beam spread. For example, lens 116 can be designed to have a beam spread of 10 degrees, 25 degrees or 40 degrees using techniques known to those skilled in the art. Other beam spread angles are possible. According to certain aspects, lenses with a plurality of pre-designed beam spreads can be interchangeably installed in luminaire 100 according to lighting effects desired for a given environment. This interchangeability is facilitated by removable twist-and-lock lens cap 120.

In embodiments, bottom surface of lens 116 may be adapted to accept various light effect accessories such as a honeycomb accessory (e.g., having 1-2 mm hexagonal cells) or a light diffusing film such as film 118.

Figure 7:
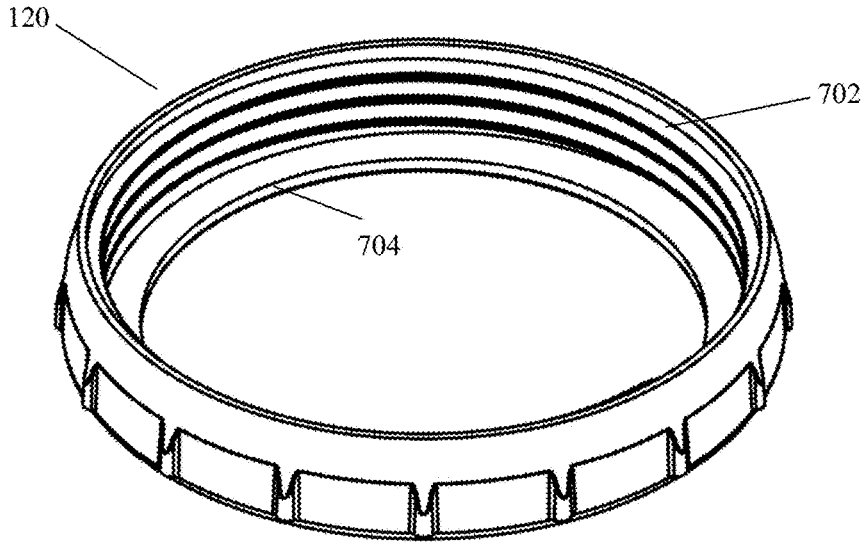
FIG. 7 is a perspective illustration of an example lens cap according to embodiments such as that shown in FIG. 1.

FIG. 7 is a perspective illustration of an example lens cap 120 according to embodiments. As shown in the example of FIG. 7, lens cap 120 includes threads 702 and ledge 704 formed on an internal periphery. Threads 702 engage with threads 306 of heat sink 110 and ledge 704 engages with flange portion 606 of lens 116. This allows different lenses 116 designed with different beam spreads to be freely interchanged in luminaire 100 from below the ceiling without removing any other components of luminaire 100.

Although the present embodiments have been particularly described with reference to preferred ones thereof, it should be readily apparent to those of ordinary skill in the art that changes and modifications in the form and details may be made without departing from the spirit and scope of the present disclosure. It is intended that the appended claims encompass such changes and modifications.

What is claimed is:

1. A luminaire, comprising:

a housing that completely encloses a light source module, the light source module including at least a power supply, wherein the housing including the enclosed light source module are installed within a cavity of a junction box; and a heat sink that accommodates a light source, wherein the heat sink is tiltable with respect to the housing while remaining fastened to the housing but without being fastened to the junction box, such that the heat sink is attached to the junction box via the housing.

2. The luminaire of claim 1, wherein the housing includes an inner surface adjacent to a top surface of the heat sink, and wherein the inner surface of the housing and the top surface of the heat sink have matching shapes.

3. The luminaire of claim 2, wherein the matching shapes are hemispherical.

4. The luminaire of claim 1, wherein the housing includes a track for accommodating a bushing that is fastened to the heat sink, wherein the track and bushing allow for the heat sink to tilt with respect to the housing.

5. The luminaire of claim 1, further including electrical wires between the heat sink and the housing for providing electrical power from the power supply to the light source, the heat sink and the housing being adapted to allow for the wires to travel when the heat sink tilts with respect to the housing.

6. A luminaire comprising:

a housing that accommodates a light source module, the light source module including at least a power supply;

a heat sink that accommodates a light source, wherein the heat sink is tiltable with respect to the housing while remaining fastened to the housing; and a mounting ring coupled to the housing, wherein the mounting ring is rotatable with respect to the housing while remaining coupled to the housing.

7. The luminaire of claim 6, wherein the mounting ring is adapted to be coupled to a trim, wherein the trim allows for lighting effects of the luminaire to be changed when the mounting ring rotates with respect to the housing.

8. The luminaire of claim 6, wherein the mounting ring has an inner surface that includes detents, wherein the detents cause a clicking when the mounting ring rotates with respect to the housing.

9. The luminaire of claim 1, wherein the housing is adapted to be installed in the junction box above a ceiling line.

10. The luminaire of claim 9, wherein the heat sink is accessible from below the ceiling line and can thereby be tilted when the housing is installed in the junction box.

11. The luminaire of claim 7, wherein the housing is adapted to be installed in a junction box above a ceiling line.

12. The luminaire of claim 11, wherein the trim is accessible from below the ceiling line and can thereby be rotated when the housing is installed in the junction box.

13. The luminaire of claim 1, wherein the heat sink is tiltable up to 45 degrees with respect to the housing.

14. The luminaire of claim 6, wherein the mounting ring is rotatable up to 360 degrees with respect to the housing.

15. The luminaire of claim 1, further including a mounting ring coupled to the housing, wherein the mounting ring is rotatable with respect to the housing while remaining coupled to the housing.

16. The luminaire of claim 15, wherein the mounting ring is adapted to be coupled to a trim, wherein the trim allows for lighting effects of the luminaire to be changed when the mounting ring rotates with respect to the housing.

17. The luminaire of claim 15, wherein the mounting ring has an inner surface that includes detents, wherein the detents cause a clicking when the mounting ring rotates with respect to the housing.

18. The luminaire of claim 6, wherein the housing is adapted to be installed in a junction box above a ceiling line.

19. The luminaire of claim 18, wherein the heat sink is accessible from below the ceiling line and can thereby be tilted when the housing is installed in the junction box.

20. The luminaire of claim 16, wherein the housing is adapted to be installed in a junction box above a ceiling line.

21. The luminaire of claim 20, wherein the trim is accessible from below the ceiling line and can thereby be rotated when the housing is installed in the junction box.

22. The luminaire of claim 6, wherein the heat sink is tiltable up to 45 degrees with respect to the housing.

23. The luminaire of claim 1, wherein the mounting ring is rotatable up to 360 degrees with respect to the housing.

* * * * *